US005875958A

United States Patent [19]

Weiteder et al.

[11] Patent Number: 5,875,958

[45] Date of Patent: Mar. 2, 1999

[54] CUBOID FLAT GABLE COMPOSITE PACKAGE AND A PROCESS FOR ITS PRODUCTION

[75] Inventors: Hans Josef Weiteder, Herzogenrath; Matthias Dammers, Alsdorf, both of Germany

[73] Assignee: PKL Verpackungssysteme GmbH, Linnich, Germany

[21] Appl. No.: 716,228

[22] PCT Filed: Mar. 18, 1995

[86] PCT No.: PCT/EP95/01021

§ 371 Date: Nov. 5, 1996

§ 102(e) Date: Nov. 5, 1996

[87] PCT Pub. No.: WO95/25669

PCT Pub. Date: Sep. 28, 1995

[30] Foreign Application Priority Data

Mar. 23, 1994 [DE] Germany ..... 44 09 946.0

[51] Int. Cl.[6] ..... B65D 5/72

[52] U.S. Cl. ..... 229/125.15; 229/125.04; 229/125.05; 493/87; 493/102; 493/114

[58] Field of Search ..... 229/125.04, 125.05, 229/125.09, 125.14, 125.15; 220/254, 258, 270; 222/541.5, 541.9, 556; 493/87, 102, 114

[56] References Cited

U.S. PATENT DOCUMENTS

| | | | |
|---|---|---|---|
| 3,239,112 | 3/1966 | Porcelli | 220/258 |
| 3,282,477 | 11/1966 | Henchert | 220/258 |
| 3,434,620 | 3/1969 | Lauizio | 220/258 |
| 4,724,978 | 2/1988 | Cleevely et al. | 220/258 |
| 4,828,135 | 5/1989 | Kawakami et al. | 220/270 |
| 4,863,047 | 9/1989 | Crow | 220/258 |
| 4,901,892 | 2/1990 | Song | 222/498 |
| 4,913,294 | 4/1990 | Giacomelli | 206/621.6 |
| 4,915,290 | 4/1990 | Robichaud et al. | 229/125.08 |
| 5,069,372 | 12/1991 | Kawajiri | 220/270 |
| 5,133,486 | 7/1992 | Moore et al. | 220/270 |

FOREIGN PATENT DOCUMENTS

| | | | |
|---|---|---|---|
| 0165639 | 12/1985 | European Pat. Off. . | |
| 0368168 | 5/1990 | European Pat. Off. . | |
| 0577866 | 1/1994 | European Pat. Off. . | |
| 3808303A1 | 3/1988 | Germany . | |
| 40/5051035 | 3/1993 | Japan | 229/125.04 |

*Primary Examiner*—Gary E. Elkins
*Attorney, Agent, or Firm*—Standley & Gilcrest

[57] ABSTRACT

The specification represents and describes a cuboid flat gable package, with the composite having at least one carrier layer made from paper or cardboard, a coupling layer, an oxygen barrier layer and a double-sided plastic coating made from polyethylene (PE). An opening area is provided in the package gable which which is adapted to be severed to form a pour opening pouring element is provided with a reclosable closing lid being hinged thereto in one piece and whose flange encompassing the opening area is rigidly connected to the package surface and whose closing lid is provided with a tubus corresponding to the shape of the opening area. In order to reduce the overall height of the pouring element used and to reliably ensure a perfect pouring it is provided that in the zone of the opening area the carrier layer is omitted and that an opening aid for pulling out the composite portion situated in the zone of the opening area is attached on the package gable in the interior of the opening area which has been sealed over. The specification further describes a process for producing such a flat gable composite package.

12 Claims, 2 Drawing Sheets

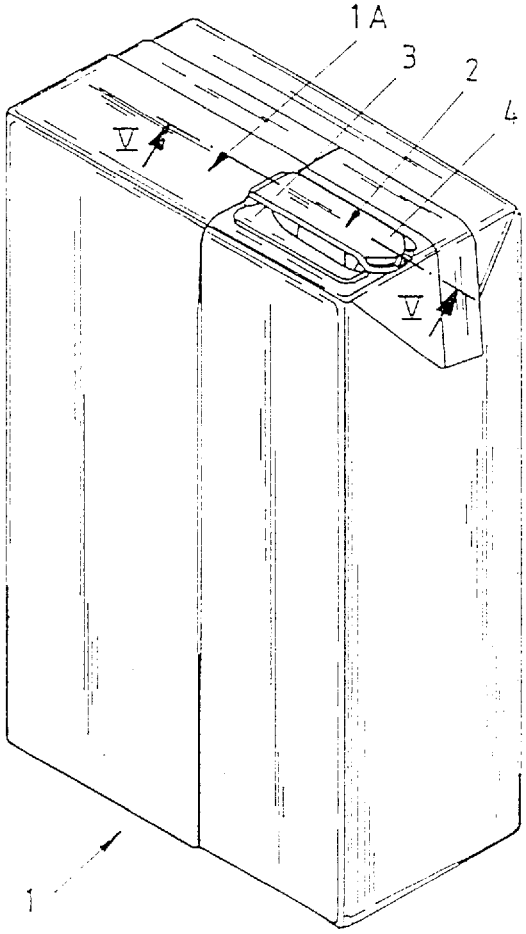
Fig.1
Fig.2
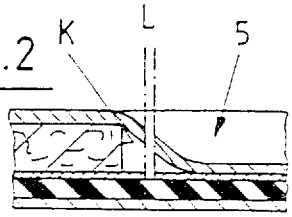
Fig.3A
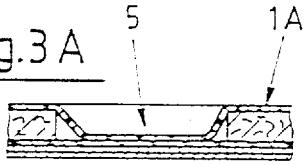
Fig.3B
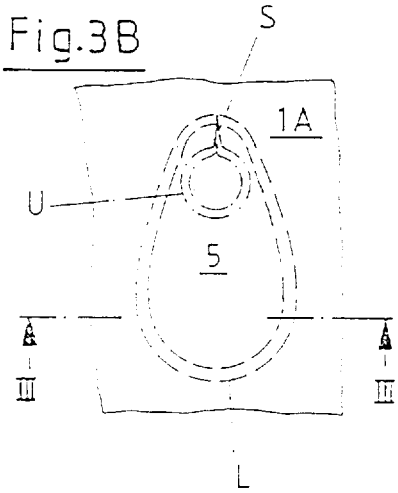
Fig.4
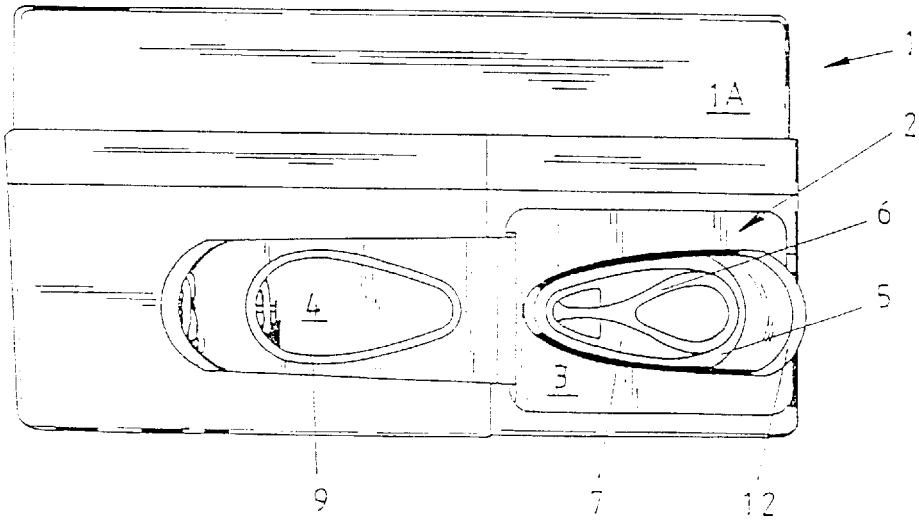

CUBOID FLAT GABLE COMPOSITE PACKAGE AND A PROCESS FOR ITS PRODUCTION

The invention relates to a cuboid flat gable composite package, in particular a tab package with central seam or corner seam, with the composite having at least one carrier layer made from paper or cardboard, a coupling layer, an oxygen barrier layer preferably made from aluminium, and a double-sided plastic coating made from polyethylene (PE), with an opening area provided in the package gable which forms the pour opening after the severing, with a pouring element provided with a reclosable closing lid being hinged thereto in one piece and whose flange encompassing the opening area is rigidly connected to the package surface and whose closing lid is provided with a tubus corresponding to the shape of the opening area, as well as to a process to produce such a flat gable composite package.

Cuboid flat gable packages are known in numerous arrangements. They are used predominantly in the field of liquid packages in connection with cold, cold-sterile, hot and aseptic fillings. These packages can usually not be closed any more once they are opened.

It has therefore already been proposed in connection with flat gable composite packages of the kind mentioned above to arrange a pouring element in the package gable which is equipped with a respective closing lid (DE 38 08 303 A1). A circular severing line to weaken the gable material is provided in the zone of the cardboard layer and the outer PE layer, into which a respective tubus, which is connected with the closing lid in one piece and corresponds to the shape of the circular severing line, is pressed into the package material in order to open the package. For the purpose of easier severing of the weakened severing line, the lower edge of the tube is provided with suitable mechanical opening means such as blades or the like.

The aforementioned flat gable composite package can be improved in respect of several items. It is clear that for the purpose of storage and transportation it must be ensured that the tubus connected with the closing lid must not penetrate the material prior to the first use of the package. For this purpose a strap is provided according to the current state of the art for this kind of inventions which fixes at a specific distance the closing lid and the flange of the pouring element which circles the severing line. Only after the removal of the strap is it possible to push the opening tubus into the package composite material by pressing in the closing lid. This leads to the consequence that a certain minimum height of the known pouring element is mandatorily required. This is a disadvantage owing to the stackability required for flat gable composite packages.

Another possibility is that package piece separated from the tube is detached completely from the remaining package composite and thus reaches the liquid. This is not hygienic and can also lead to problems in the pouring when the piece of the package composite freely swimming in the liquid partly or entirely "blocks" the pour opening or even reaches the drinking vessel through the pour opening.

Starting out from this, the present invention is based on the object of providing and further developing a cuboid flat gable composite package of the type mentioned above and a process for its production, so that the overall height of the pouring element used is reduced and a perfect pouring is reliably ensured.

With respect to the flat gable composite package, the solution to this object consists of omitting the carrier layer in the zone of the opening area and of providing on the package gable in the interior of the opening area which is sealed over an opening aid for pulling out the composite portion situated in the zone of the opening area.

With respect to the production process of such a flat gable composite package, the object is achieved by the following steps:

Producing the opening area in the carrier layer in the zone of the future pour opening;

applying the outer PE layers;

laminating of an aluminium layer;

applying the inner PE layers;

corrugating the multi-layer composite;

prefolding the package blank;

sealing the longitudinal seam into a tube-like package envelope;

applying the opening aid on the opening area as well as folding and sealing the package floor;

folding and sealing the package gable after the filling of the package and applying the pouring element provided with the closing lid on the opening area of the completed package.

As a result of the fact that the package surface is provided with a PE layer, it is particularly favourable that both the flange of the pouring element encompassing the opening area as well as the opening aid which is provided in the interior of the opening area are sealed on. It is understood that the pouring element and the opening aid must consist of respective sealable material such as polypropylene.

In a preferable further development of the invention the opening aid consists of tear-resistant, sealable and ultrasonically weldable material and is welded with the layer composite in the interior of the opening area. In this respect it is particularly favourable when the ultrasonic welding seam is adapted essentially to the shape of the opening of the pouring element. This leads to a complete removal of the composite element situated in the interior of the opening following the removal of such an opening aid. It is clear that the opening aid should not project beyond the zone of the opening of the pouring element so as not to impair the later application of the pouring element on the package surface.

Both in cases of opening aids which are sealed on as well as opening aids which are welded on ultrasonically, it is of particular advantage that the geometry of the opening aid is selected in such a way that tearing open of the package occurs at first locally at a single start-tearing position. This can occur for example in such a way that the circular sealing or ultrasonic welding seam is provided with an unevenness formed as a tip or the like from where the tearing process begins.

A further doctrine of the invention provides that the opening area is produced by means of laser beams. The production by means of laser is to be regarded as the preferable technique owing to the favourable conformability of this technology and the absolutely clean cutting edge. Nevertheless, according to an alternative embodiment of the invention it is also possible to produce the opening area by punching.

In a further embodiment of the invention the opening aid is provided with a base plate and a handle provided on the base plate for lifting the same. It is particularly preferable that the base plate consists of flexible material and that a ring strap is provided as handle. In this way the package composite material situated in the zone of the opening area below the base plate can be removed simply by joint pulling out with base plate and ring strap.

It is clear that in accordance with the invention the overall height of the pouring element can be reduced considerably as compared with the current state of the art, because a circular closing strap causing a predetermined distance between closing lid and flange of the pouring element is no longer required. It is also excluded reliably that the aforementioned problems can again occur during the pouring process because the portion of the "remaining composite" from the pour opening forming the opening area can never reach the interior of the package. Instead, it is removed outwardly prior to the first use. For the purpose of easier opening at least the upper PE layer is severed along the circular edge of the opening area.

The invention is now explained in closer detail by reference to the enclosed drawing showing merely an embodiment, wherein:

FIG. 1 shows a cuboid flat gable composite package in accordance with the invention in a perspective view;

FIG. 2 shows a section of the flat gable composite Package in accordance with the invention in the zone of an opening area arranged in the gable in a sectional view along the line V—V from FIG. 1;

FIG. 3A shows a section of the flat gable composite package in accordance with the invention in the zone of an opening area from FIG. 2 in a sectional view along the line III—III from FIG. 3B;

FIG. 3B shows the zone of the pour opening of the flat gable composite package from FIG. 3A in a top view;

FIG. 4 shows in a top view the flat gable composite package in accordance with the invention with the pouring element flipped open;

Figure 5:
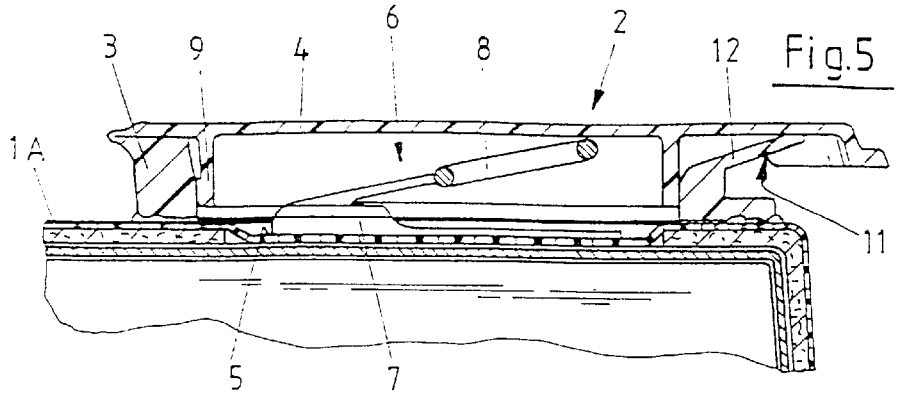
FIG. 5 shows a section of the flat gable composite package in accordance with the invention in a cross section along the line V—V in FIG. 1.

FIG. 1 shows a cuboid flat gable composite package 1 in accordance with the invention in its entirety in a perspective view. The embodiment shown concerns a tab package with a central or corner seam. It can be recognized further that there is a pouring element 2, which is rigidly connected with the flat gable composite package 1, with a flange 3 which is rigidly connected to the package surface 1A and is provided with a closing lid 4. An opening surface 5, which is not shown in FIG. 1, is provided below the pouring element.

FIGS. 2, 3A and 3B show different embodiments of the aforementioned opening area 5. FIG. 2 represents a section of an edge K of the opening area 5. The edge K of the opening area 5 shows that it has been produced by means of laser beam cutting. The individual layers of FIGS. 2, 3A and 3B are not designated in closer detail, but are represented as follows from the top to the bottom (from the outside to the inside): PE layer, paper or cardboard layer, coupling layer, oxygen barrier layer, PE layer.

An opening aid 6 is applied in accordance with the invention on the package gable in the interior of the opening area 5, as is shown in particular in FIG. 4. in the represented and thus preferable embodiment the opening aid 6 is provided with a base plate 7 and a handle means 8 provided on the base plate 7 for lifting the same. In a preferred embodiment of the invention the handle means 8 is arranged as a ring strap.

Figure 6:
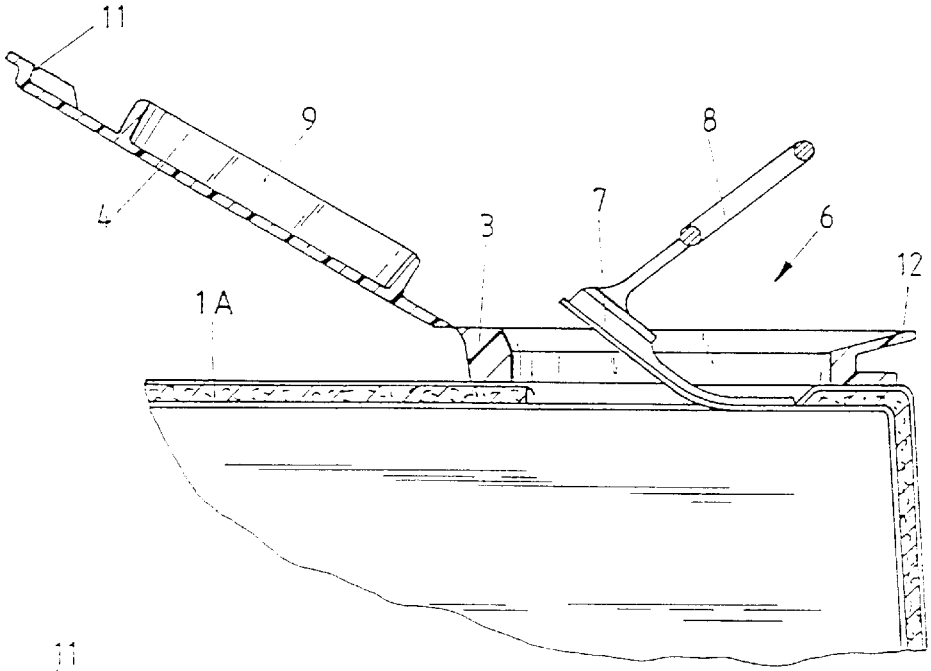
FIG. 6 shows the section pursuant to FIG. 5 with an opened pouring element and a partly opened pouring hole and FIG. 7 shows the section pursuant to FIG. 5 with opened pouring element and a fully opened pouring hole.
Figure 7:
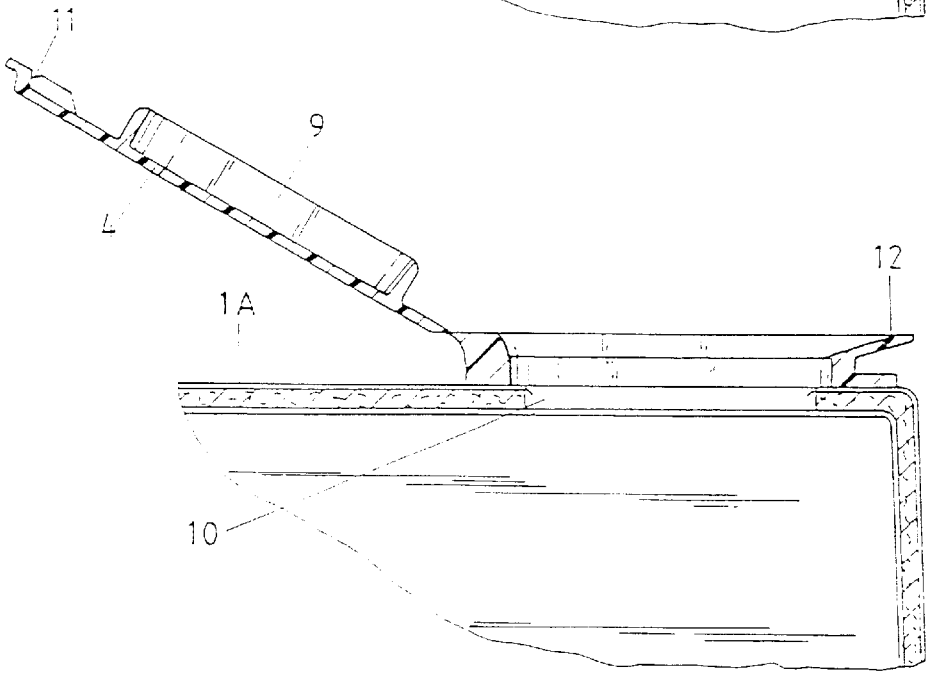

The pouring element 2, which is used in accordance with the invention, is shown in a longitudinal section for better clarity in FIGS. 5 to 7. FIG. 5 shows an embodiment of pouring element in accordance with the invention in the closed condition. The closing lid 4 is arranged in a hinged manner to the vertical part of the flange 3 encompassing the severing line. The closing lid 4 is further provided with a tubus 9 corresponding to the shape of the opening area 5, as is also shown in FIGS. 4, 6 and 7.

FIG. 3B shows further that within the opening area 5 there can also be arranged an opening aid (not shown) which consists of tear-proof, sealable and ultrasonic-weldable material and which is ultransonically welded with the outer PE layer of the package. Such an ultrasonic welding seam is indicated with the dot-dash line U. It can be seen that the circular ultrasonic welding seam is provided with an inconsistency, namely a tip S used as a start-tearing position, which reaches up to the edge of the opening area 5. In this way it is ensured reliably that on actuating the opening aid (no; shown) the tearing open of the opening area 5 occurs in the zone of the tip S. From there a two-sided tearing open occurs along the opening profile, particularly in cases when—as is indicated in FIGS. 3*b* and 2—the upper PE layer has been severed by means of a laser beam L along the opening shape.

In the variant with the ultrasonic welding seam, the opening aid 6 can consist of a piece of foil whose outer dimensions do not project over the shape of the opening area so as not to impair the later application of the pouring element 2.

For opening the flat gable composite package in accordance with the invention the closing lid 4 is lifted and thus brought into the position of FIGS. 6 and 7. Thereafter the opening aid 6 is lifted by means of the handle means 8, which is attached to the base plate 7, jointly with the residual composite portion formed by the opening area 5 by tearing the lower layers until a completely extracted pouring hole 10 arises, as is represented in FIG. 7. By renewed closure of the closing lid 4 the tubus 9 can be anchored in the interior of the circular flange 3. A projection 11 is provided at the tip of the closing 4 for improved sealing, which projection encompasses the pour spout 12 formed by the pouring element 2 at least on the side opposite of the hinge, as is shown in particular in FIG, 5.

Finally, In accordance with a further doctrine of the invention the outer PE layer is destroyed in the area of the edges of the opening area, e.g. by laser radiation. It is also possible, however, by respective increase or the intensity of the laser beam L to destroy the coupling layer, as is indicated fin FIG. 2 by the dot-dash line. In this case the opening area 5 is still provided with four layers. The circular severing line, however, only consists of oxygen barrier layer and inner PE layer.

We claim:

1. A cuboid flat gable package prepared from a composite having at least one carrier layer made from paper or cardboard, a coupling layer, an oxygen barrier layer, and a double-sided plastic coating made from polyethylene (PE), with an opening area provided in the package gable which is adapted to be severed to form a pour openin, with a pouring element provided with a reclosable closing lid and a flange encompassing the opening area that is rigidly connected to the package surface, the closing lid provided with a tubus corresponding to a shape of the opening area, characterized in that in a zone of the opening area the carrier layer is omitted and that an opening aid for pulling out a composite portion situated in the zone of the opening area is attached on the package gable in an interior of the opening area which has sealed over.

2. A flat gable composite package as claimed in claim 1, wherein the opening aid is sealed onto an outer PE layer of the composite.

3. A flat gable composite package as claimed in claim 1, wherein the opening aid is comprised of tear-proof, sealable and ultrasonic-weldable material and is ultrasonically welded with the layer composite in the zone of the opening area.

4. A flat gable composite package as claimed in claim 3, wherein an ultrasonic welding seam is substantially adapted to a shape of an opening of the pouring element.

5. A flat gable composite package as claimed in claim 2, wherein the opening aid is applied to the outer PE layer in such a way that the tearing open of the package occurs at first locally at a start-tearing position.

6. A flat gable composite package as claimed in claim 1, wherein the omission of the carrier layer in the opening area is produced by means of punching.

7. A flat gable composite package as claimed in claim 1, wherein the omission of the carrier layer in the opening area is produced by means of a laser.

8. A flat gable composite package as claimed in claim 1, wherein the opening aid is provided with a base plate and a handle means arranged on the base plate for lifting the base plate.

9. A flat gable composite package as claimed in claim 8, wherein the base plate is comprised of flexible material.

10. A flat gable composite package as claimed in claim 8, wherein a ring strap is provided as the handle means.

11. A flat gable composite package as claimed in claim 1, wherein at least an upper PE layer along a circular edge of the opening area is adapted to be severed.

12. A process for producing a cuboid flat gable composite package, comprising:

producing an opening area in a carrier layer in a zone of a future pour opening;

applying outer PE layers;

laminating of an aluminium layer;

applying inner PE layers;

prefolding a package blank;

sealing a longitudinal seam into a package envelope;

attaching an opening aid on the opening area as well as folding and sealing a package floor;

folding and sealing a package gable after filling the package; and applying a pouring element provided with a closing lid on the opening area of the package.

* * * * *

UNITED STATES PATENT AND TRADEMARK OFFICE

CERTIFICATE OF CORRECTION

PATENT NO. : 5,875,958
DATED : March 2, 1999
INVENTOR(S) : Weiteder, et al

It is certified that error appears in the above-indentified patent and that said Letters Patent is hereby corrected as shown below:

Column 4, line 18, delete "no;" and insert - -not- -;

line 46, delete "or" and insert - -of- -;

line 48, delete "fin" and insert - -in- -; and line 58, claim 1, delete "openin" and insert - -opening- -.

Signed and Sealed this

Ninth Day of November, 1999

*Attest:*

Q. TODD DICKINSON

*Attesting Officer*

*Acting Commissioner of Patents and Trademarks*